United States Patent [19]

Nason

[11] 4,321,820

[45] Mar. 30, 1982

[54] PIPE-BENDING TOOL

[76] Inventor: Bruce F. Nason, 20620 Crawford Rd., Lynnwood, Wash. 98036

[21] Appl. No.: 189,775

[22] Filed: Sep. 22, 1980

[51] Int. Cl.[3] ..... B21D 7/02

[52] U.S. Cl. ..... 72/459; 72/36

[58] Field of Search ..... 72/458, 459, 457, 32, 72/34, 35, 36, 461

[56] References Cited

U.S. PATENT DOCUMENTS

| | | | |
|---|---|---|---|
| 1,859,406 | 5/1932 | Meighan | 72/459 |
| 2,349,525 | 5/1944 | St. Clair | 72/36 |
| 2,953,048 | 9/1960 | Brown | 72/459 |
| 3,063,314 | 11/1962 | Benfield | 72/458 |
| 4,282,737 | 8/1981 | Maples | 72/32 |

*Primary Examiner*—Gene P. Crosby

*Attorney, Agent, or Firm*—Seed, Berry, Vernon & Baynham

[57] ABSTRACT

A pipe-bending tool which includes a pipe-bending head mounted on a handle assembly having an adjustable gauge arm which allows an operator of the tool to accurately bend a pipe or hollow conduit to a desired bending angle. The gauge arm projects from the handle and terminates in a stop member which can be positioned at a plurality of preset locations along the handle where it contacts the pipe during bending and prevents it from bending beyond the angle desired.

10 Claims, 7 Drawing Figures

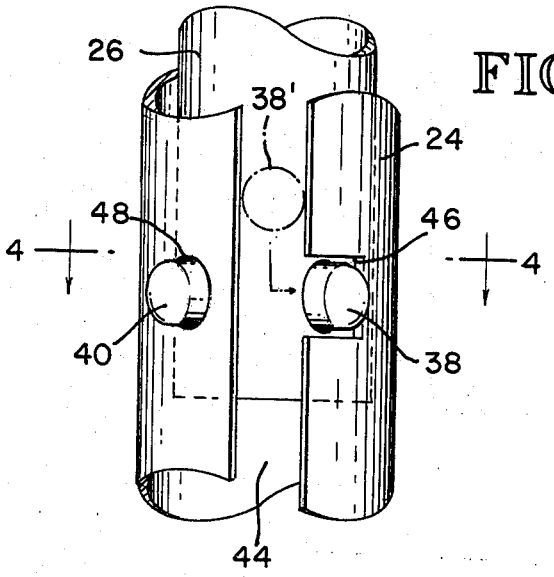
FIG. 3
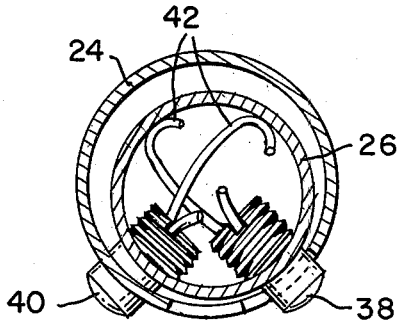
FIG. 4
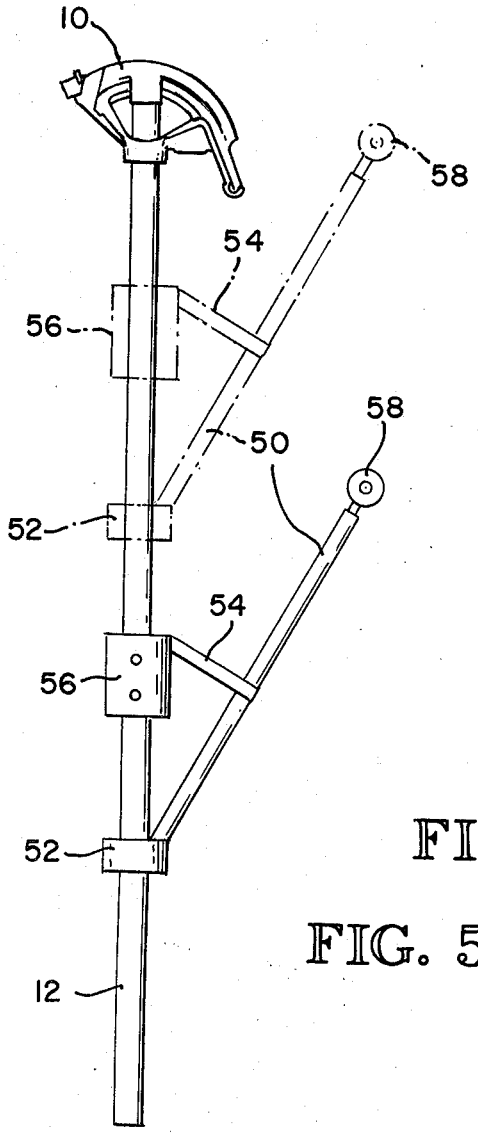
FIG. 5
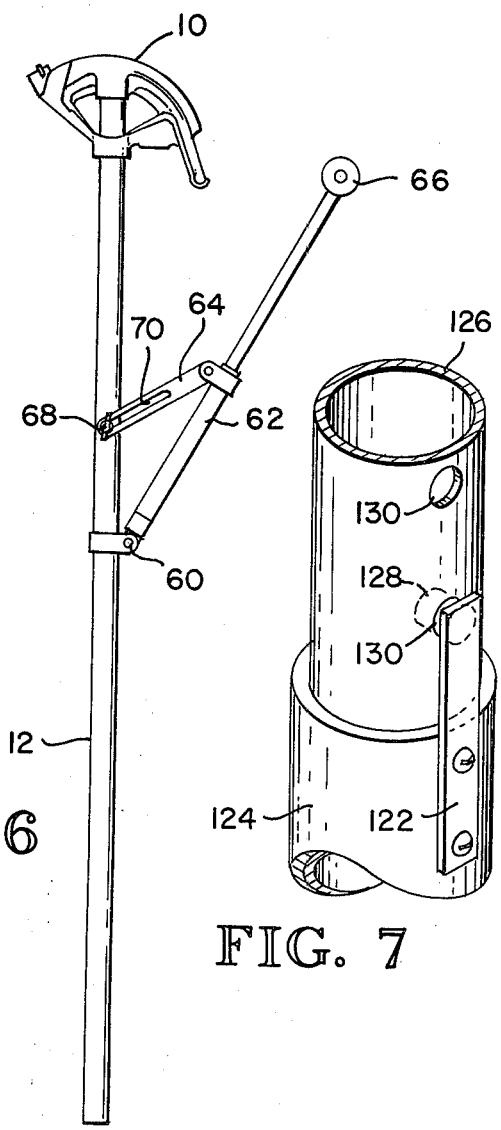
FIG. 6
FIG. 7

PIPE-BENDING TOOL

BACKGROUND OF THE INVENTION

1. Field of the Invention

This invention relates to pipe-bending tools and, more particularly, to methods of gauging the angle to which pipes are bent.

2. Description of the Prior Art

It is often necessary for a person installing pipe or electrical conduits to bend the pipe or conduit to meet the needs of a particular installation job. Existing pipe-bending tools utilize a bending head having a curved surface against which the pipe is made to conform so that the angle to which the pipe is bent is proportional to the length of contact between the pipe and the curved surface.

Existing methods of gauging the angle to which the pipe is to be bent require the installer either to visually align the pipe with indicia on the pipe-bending head or to adjust a stopping device located on the pipe-bending head itself which either limits movement of the bending head or limits the length of contact between the pipe and the curved surface.

When the visual alignment method is used, the installer must be located within view of the indicia on the pipe-bending head and carefully apply enough force to bend the pipe around the bending head until it lines up with the indicia which corresponds to the desired bending angle. If too much force is applied by the installer, the pipe will bend beyond the desired bending angle, resulting in loss of time and material. The degree of care required to accurately gauge bends significantly decreases the speed at which pipe can be bent using the visual alignment method.

Existing methods of stopping the pipe when it is bent to the desired angle require the installer to adjust a stopping device on the pipe-bending head before the pipe is placed in the tool. These adjustments will typically require the installer to: loosen a screw or bolt which secures the stopping device in place; set the stopping device for the desired bending angle by fitting it into a notch built into the bending head or aligning it with indicia located on the tool; and finally, tighten a screw or bolt to resecure the stopping device. Because stopping devices which limit the length of contact between the pipe and the curved surface contact the pipe relatively close to the center of the bending arc, any error in setting these stopping devices will result in a magnified error in the actual angle to which the pipe is bent. Stopping devices which limit movement of the bending head itself generally cannot be used on soft surfaces typically found at construction sites. Also, they are inherently inaccurate since the stop member is located on the bending head itself.

SUMMARY OF THE INVENTION

The principal object of the invention is to provide a pipe-bending tool which will quickly, easily and accurately gauge the desired bending angle.

This and other objects of the invention are accomplished by mounting a gauge arm which terminates in a stop member on the handle of a conventional pipe-bending tool. The pipe contacts the stop during bending and prevents it from further bending. The position of the stop member along the longitudinal axis of the handle may be varied to vary the bending angle. In one embodiment of the invention, the length of the gauge arm is varied to corresponding to common pipe-bending angles (such as 90°, 60°, 45°, etc.). One alternate embodiment of the invention entails the use of a slidable connecting means between the handle and the gauge arm which permits the gauge arm to slide relative to the handle. In this embodiment, an extendable gauge arm is not necessary as the location of the projecting end of the gauge arm can be set by adjusting the slidable connecting means and securing it in place. A second alternative embodiment of the invention entails the use of a pivoting connecting means between the handle and the gauge arm to vary the location of the stop member mounted on the end of the gauge arm. In this embodiment, an extendable gauge arm is not necessary as the location of the projecting end of the gauge arm may be set by rotating the arm to the desired position and then utilizing a means of securing the gauge arm in place.

BRIEF DESCRIPTION OF THE DRAWINGS

FIG. 3 is a detailed view of the gauge arm showing the button-stop groove means of securing the extension gauge to the gauge sleeve.

FIG. 4 is a cross-section of the gauge arm taken along the line 4—4 of FIG. 3 illustrating the spring-loaded, depressible buttons of the extension gauge.

FIG. 5 is a side elevation view of an alternate embodiment of the invention having a slidable connecting means between the gauge arm and the handle.

FIG. 6 is a side elevation view of still another embodiment of the invention having a pivoting connecting means between the gauge arm and the handle.

FIG. 7 is a broken isometric view of an alternative structure for adjusting the length of the gauge arm.

DETAILED DESCRIPTION OF THE PREFERRED EMBODIMENTS

Figure 1:
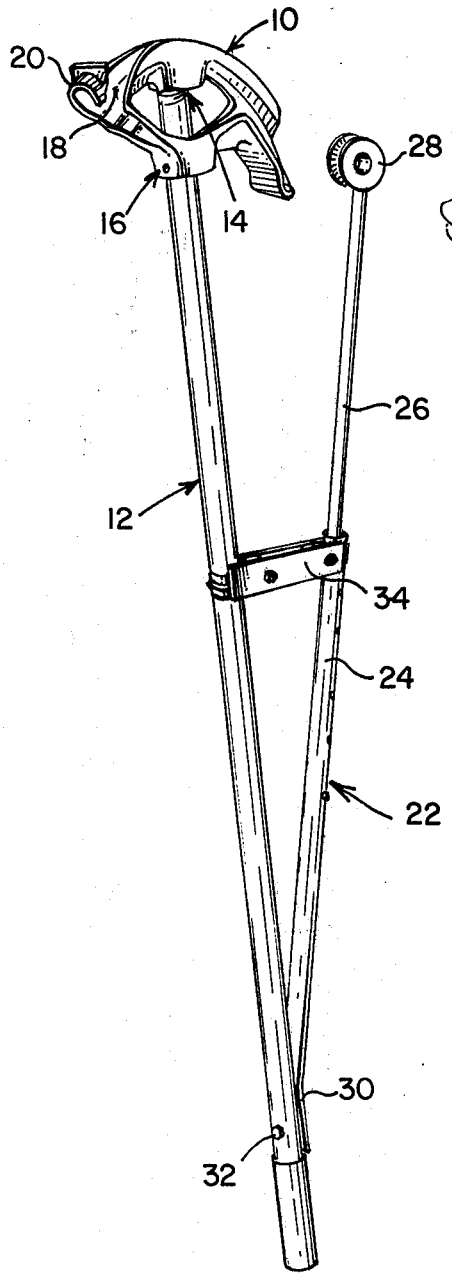
FIG. 1 is an isometric view of the one embodiment of the invention.
Figure 2:
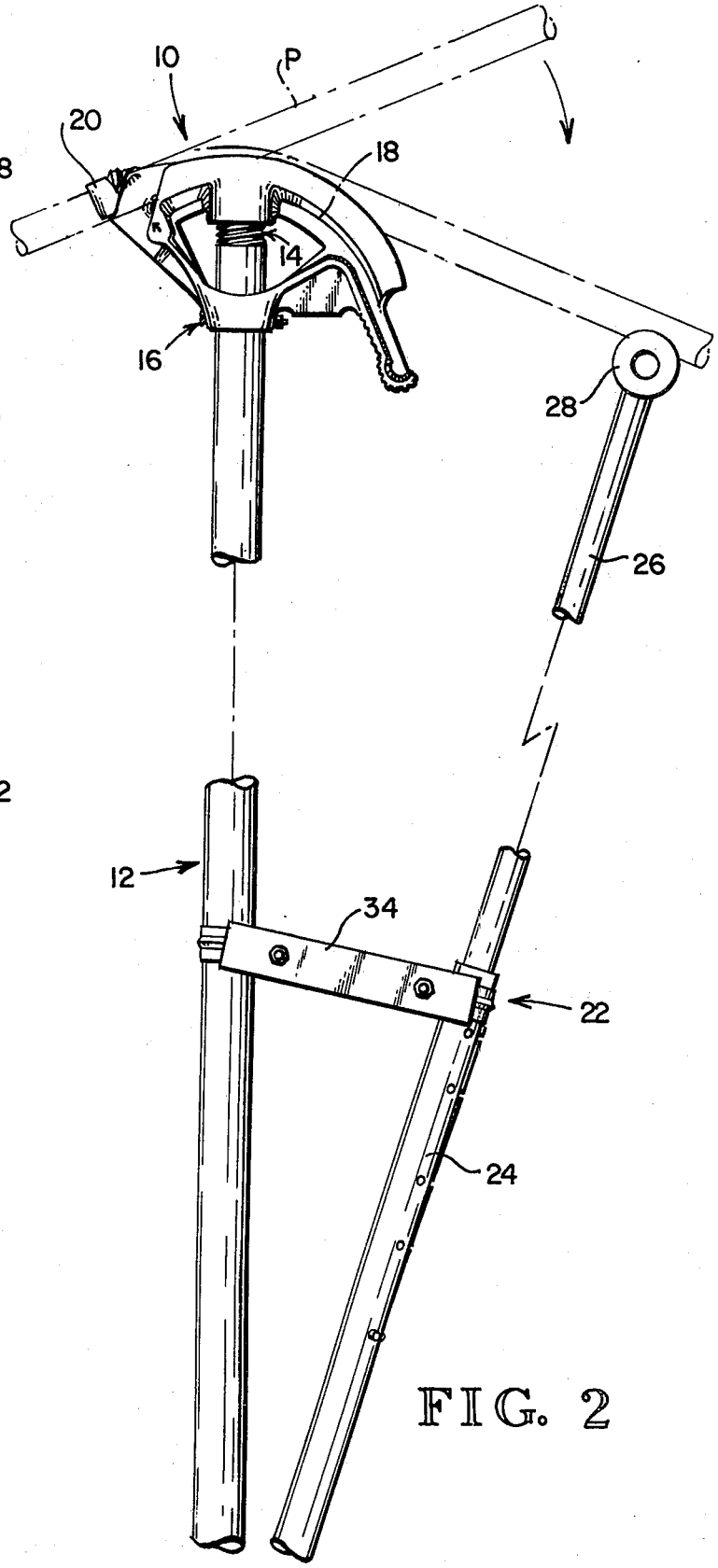
FIG. 2 is a side elevation view of the embodiment of FIG. 1 illustrating a pipe positioned in the tool.

The pipe-bending tool illustrated in FIGS. 1 and 2 includes a pipe-bending head 10 attached to a handle 12 by means of a threaded connection 14 located at one end of the handle and a screw and nut assembly 16 extending through the bottom of the pipe-bending head 10 and the handle 12. Although the pipe-bending head 10 illustrated herein is commercially available from one manufacturer, it will be understood that the invention described herein is applicable to other styles of bending heads and to other techniques of mounting the bending head 10 on the handle 12.

As best illustrated in FIG. 2, the pipe-bending head includes a curved bending channel 18 having an anchor 20 at one end. A pipe P is placed in the channel 18 beneath the anchor 20 and the portion projecting from the other end of the channel 18 is forced in the direction indicated. The pipe P is thus made to conform to the curvature of the bending channel 18. The angle of the bend is proportional to the length of contact between the pipe P and channel 18, which is determined by the distance the projecting end of the pipe P is moved downwardly, as indicated.

In the past, the angle of the bend has been determined by aligning the pipe P with angle indicia on the side of the bending head 10. This procedure is inaccurate and time-consuming. Other techniques for controlling the angle of the bend either limit the length of contact between the pipe P and channel 20 or limit the movement of the handle 12 to a predetermined arc. Neither of these techniques is satisfactory for the reasons set forth above.

The inventive pipe-bending tool gauges the angle of the bend by limiting the downward movement of the pipe P. Accordingly, a gauge arm 22 projects from near the free end of the handle 12 toward the bending head 10. The gauge arm 22 is comprised of an extension sleeve 24 loosely surrounding an extension arm 26 so that the sleeve 24 and arm 26 can slide with respect to each other to vary the length of the gauge arm 22. A stop member 28 is mounted on the end of the gauge arm 26. The stop member 28 is positioned along the axis of the bending channel 18 so that a pipe P positioned in the channel 18 contacts the stop member 28 as it is bent. The stop member 28 thus limits the bending movement and, hence, bending angle, of the pipe P as determined by the length of the gauge arm 22.

Although a variety of gauge arm structures may be used, the gauge arm 22 of FIGS. 1–4 utilizes elongated tubes as the extension sleeve 24 is flattened at 30 and secured to the handle 12 by a screw or bolt 32. A brace 34 connected between the handle 12 and extension sleeve 24 is provided to more securely fasten the handle 12 to the sleeve 24.

As mentioned above, the angle of the bend is determined by the length of the gauge arm 22. Consequently, it is necessary to provide some structure for fixing the position of the extension arm 26 with respect to the extension sleeve. For this purpose, as best illustrated in FIGS. 3 and 4, two depressible buttons 38,40 are mounted which project radially from the inside of the extension arm 26. Each button 38,40 is held in place by a spring 42 inside the extension arm 26 so that the buttons 38,40 project beyond the outer periphery of the extension arm 26. When an inward force is applied to the buttons 38,40, the buttons 38,40 retreat inside the extension arm 26 until the projecting ends of the buttons 38,40 are flush with the outer surface of the extension arm 26.

When the extension arm 26 slides relative to the extension sleeve 24, one of the buttons 38 projects through a long thin slot 44 in the sleeve 24, as shown in phantom at 38'. The slot 44 runs along the longitudinal axis of the sleeve 24 and is slightly wider than the width of a depressible button 38. The other button 40 travels in a depressed position, held in place by the inner wall of the sleeve 24.

At each of a plurality of predetermined securing locations along the longitudinal axis of the extension sleeve which correspond to desired gauge arm lengths is located a rectangular button-stop groove 46 which extends transversely from the slot 44 and is large enough that a button 38 will slide inside it. Adjacent each button-stop groove 46, a transversely offset aperture 48 is formed in the sleeve 24 which is slightly larger than a button 40. Each aperture 48 is located the same distance from the corresponding button-stop groove 46 as the distance between the buttons 38,40. When the visible depressible button 38 in slot 44 is adjacent a button-stop groove 46 at a securing location, the extension arm 26 is rotated counterclockwise relative to the extension sleeve 24, moving the button 38 travelling into the button-stop groove 46 and allowing the other button 40 to project through the adjacent aperture 48, thereby preventing movement of the extension arm 26 relative to the extension sleeve 24. In order to readjust the position of the extension arm 26 relative to the extension sleeve 24, the button 40 projecting through the aperture 48 is depressed and the extension arm 26 is rotated until the button 38 formerly located in the button-stop groove 46 returns to the slot 44. The button 40 is then held in its depressed position by the sleeve 24 so that the extension arm 26 may be moved to a new position in the sleeve 24.

Other structures for adjusting the length of the gauge arm may also be used. For example, as illustrated in FIG. 7, a spring metal lever 122 secured to an extension sleeve 24 projects outwardly along an extension arm 126. The lever 122 carries a circular projection 128 extending inwardly into one of several spaced-apart apertures 130 in the extension arm 126. The effective length of the gauge arm can thus be adjusted by deflecting the lever 122 to remove the projection 128 from an aperture 130, moving the extension arm 126 with respect to the extension sleeve 124 and allowing the projection 128 to enter a different aperture 130.

To use the pipe-bending tool herein disclosed, the length of pipe P to be bent is placed in the pipe-bending channel 18 of the pipe-bending head 10 and releasably secured by the anchor means 20. The projecting portion of the pipe is then pulled toward the handle 12, bending the pipe P around the pipe-bending channel 18 until the pipe P contacts the stop member 28. The position of the stop member 28 along the axis of the handle 12 is adjustable by extending or retracting the extension arm 26 relative to the extension sleeve 24 and securing the extension arm 26 in position with suitable fastening means, such as the depressible button mechanism described earlier. The fastening means preferably secures the arm 26 to the sleeve 24 at discrete locations so that the stop member 28 terminates bending of the pipe P at precise predetermined angles.

An alternate embodiment of the invention is shown in FIG. 5. In this embodiment, a single member gauge arm 50 is secured to the handle 12 by a collar 52 slidably mounted on the handle 12. A stop member 58 is secured to the projecting end of the gauge arm 50. The collars 52,56 permit the gauge arm 50 to slide relative to the handle 12, thereby changing the position of the stop member 58 along the longitudinal axis of the handle 12 and allowing bending to be terminated at a variety of angles. Suitable means are provided to releasably secure the collars 52,56 to the handle 12 at predetermined locations so that pipe is bent to predetermined angles.

Another alternate embodiment of the invention is illustrated in FIG. 6. This embodiment employs a pivoting connecting means 60 for securing a single member gauge arm 62 to the handle 12. A retractable brace 64 permits the angle between the gauge arm 62 and the handle 12 to be set so that a stop member 66 intersects the longitudinal axis of the bending channel at different locations to allow bending to be terminated at a plurality of angles. A thumb screw 68 projecting through a slot 70 in the brace 64 into the handle 12 fixes the angle of the gauge arm 62 with respect to the handle 12.

Other variations of the invention will be apparent in which a stop member is aligned with the bending channel and is spaced apart from the bending head, and the position of the stop member along the longitudinal axis of the handle may be varied to vary the bending angle. Thus the embodiments illustrated herein, while preferred, are not the only embodiments of the invention.

I claim:

1. A pipe-bending tool comprising:

a pipe-bending head having a curved bending channel adapted to receive a length of pipe and anchor means positioned at one end of the bending channel to releasably secure the pipe to the channel while the remainder of the pipe is bent along the channel;

an elongated handle having a means to secure the pipe-bending head at one end thereof;

a gauge arm projecting from a location on the handle spaced apart from the bending head; and a stop member secured to the projecting end of the gauge arm, the gauge arm extending along the handle at an acute angle from the handle to position the stop member along the longitudinal axis of the bending channel adjacent the end of said channel opposite the anchor means so that the bending of the pipe toward the handle is terminated by engagement with the stop means at a predetermined location, thereby terminating the bending of the pipe at a predetermined angle.

2. The pipe-bending tool of claim 1, further including adjustment means for varying the position of said stop member along the longitudinal axis of said handle to vary the bending angle of the pipe.

3. The pipe-bending tool of claim 1 wherein said adjustable means for varying the length of said gauge arm.

4. The pipe-bending tool of claim 3 wherein said gauge arm comprises:

an elongated extension sleeve projecting from said handle at an acute angle to intersect the longitudinal axis of the bending channel;

an elongated extension arm slidably mounted on said extension sleeve and having said stop member secured to one end so that the position of the stop member along said handle may be varied; and means of releasably securing the extension arm to the extension sleeve, thereby permitting a plurality of fixed gauge arm lengths and allowing pipes positioned in the pipe-bending channel to be bent to a plurality of angles.

5. The pipe-bending tool of claim 4 wherein the elongated extension sleeve is of hollow construction with an internal dimension slightly larger than the external dimensions of the extension arm such that the extension arm is free to slide inside the extension sleeve, the means of securing the extension arm further comprising:

a spring-loaded, depressible button mounted in the extension arm, the button protruding beyond the periphery of the extension arm when in a neutral position and flush with the periphery of the extension arm when depressed; and the extension sleeve further comprising a plurality of apertures slightly larger than the depressible button, the apertures extending through the sleeve at various positions along the longitudinal axis of the gauge arm corresponding to desired gauge arm lengths such that when the extension arm is inside the extension sleeve, the button will extend through an aperture and secure the extension arm and prevent it from sliding relative to the extension sleeve.

6. The pipe-bending tool of claim 5, further including:

an additional spring-loaded, depressible button located apart from a stop means on the extension arm at a different location on a transverse cross-section of the extension arm than the first button, the additional button similarly protruding beyond the periphery of the extension arm when in a neutral position and flush with the periphery when depressed; and the extension sleeve further including a relatively long thin slot running lengthwise along the extension sleeve, the slot being somewhat wider than the depressible buttons so that the button can travel in a neutral position through the slot when an extension arm moves relative to the extension sleeve, the extension sleeve further including a plurality of button-stop grooves somewhat larger than the buttons and offset transversely and connecting to the slot at locations along the longitudinal axis of the sleeve corresponding to the locations of the apertures so that when one button is located in the slot and the extension arm is rotated toward the button-stop groove, one button will project through an aperture and another will rest in the button-stop groove.

7. The pipe-bending tool of claim 4 wherein the elongated extension sleeve is of hollow construction with an internal dimension slightly larger than the external dimension of the extension arm such that the extension arm is free to slide inside the extension sleeve, the means of securing the extension arm further comprising a resilient lever secured to said extension sleeve and projecting along said extension arm, a stop projection extending inwardly from said lever toward said extension arm and a plurality of longitudinally spaced apertures each adapted to receive said stop projection.

8. The pipe-bending tool of claim 2 wherein said adjustment means comprises means for varying the location along the length of said handle from which said gauge arm projects, thereby varying the position of said stop member along the length of said handle.

9. The pipe-bending tool of claim 2 wherein said adjustment means comprises means for varying the angle at which said gauge arm projects from said handle, thereby varying the position of said stop member along the length of said handle.

10. The pipe-bending tool of claim 1 wherein said gauge arm is pivotably secured to said handle, said tool further including means for securing the gauge arm to said handle in a collapsed position such that the gauge arm extends nearly parallel to the handle when not in use and for securing the gauge arm at a predetermined acute angle from the handle when in use.

* * * * *